US005381644A

United States Patent [19]

Di Bernardo

[11] Patent Number: 5,381,644

[45] Date of Patent: Jan. 17, 1995

[54] MACHINE FOR PACKAGING WITH SINGLE-FOLDED HEAT-SHRINKABLE FILM, PROVIDED WITH A DEVICE FOR AUTOMATICALLY OPENING THE FILM

[75] Inventor: Pietro Di Bernardo, Milan, Italy

[73] Assignee: Interdibipack S.p.A., Milan, Italy

[21] Appl. No.: 954,028

[22] Filed: Sep. 30, 1992

[30] Foreign Application Priority Data

Oct. 3, 1991 [IT] Italy ..... MI91A002637

[51] Int. Cl.[6] ..... B65B 53/02

[52] U.S. Cl. ..... 53/557; 53/385.1; 53/511; 53/568

[58] Field of Search ..... 53/385.1, 557, 562, 53/568, 434, 511, 512

[56] References Cited

U.S. PATENT DOCUMENTS

| | | | |
|---|---|---|---|
| 3,233,527 | 2/1966 | Membrino | 53/562 X |
| 3,429,100 | 2/1969 | Zelnick et al. | 53/568 |
| 3,568,400 | 3/1971 | Pitts | 53/568 |
| 3,619,973 | 11/1971 | Bella | 53/562 X |
| 4,104,848 | 8/1978 | Torre | 53/557 |
| 4,162,604 | 7/1979 | Bartolomei | 53/557 |
| 4,164,111 | 8/1979 | Di Bernardo | 53/512 X |
| 4,170,863 | 10/1979 | Schwanz . | |
| 4,393,640 | 7/1983 | Cole et al. | 53/385.1 X |
| 4,945,712 | 8/1990 | Bennett | 53/568 X |
| .5,001,884 | 3/1991 | Hanagata | 53/568 X |

*Primary Examiner*—John Sipos
*Assistant Examiner*—Daniel Moon
*Attorney, Agent, or Firm*—Diller, Ramik & Wight

[57] ABSTRACT

A machine for packaging articles is provided and includes a support for a roll of heat-shrinkable film (12) defined by a fold and two opposing faces (13, 14) which is drawn in a predetermined direction between an article loading station and a film heat shrinking and sealing station. Air is directed transversely to the predetermined direction to open the opposing faces (13, 14) to facilitate the introduction of an article between the faces (13, 14) of the film (12). Thereafter the packaged film is advanced to a heat shrinking and sealing station which includes a chamber (11) having a movable hood (15) and a support (20) with apertures through which hot air can be circulated for shrinking the film. At the same time, an exhaust fan (25) exhausts air from the chamber (11) and the interior of the folded film (12) incident to the shrinking thereof and the eventual heat sealing of at least the free edges of the film faces (13, 14). A pivoted damper (29) controls the flow of air associated with the blower (24).

3 Claims, 6 Drawing Sheets

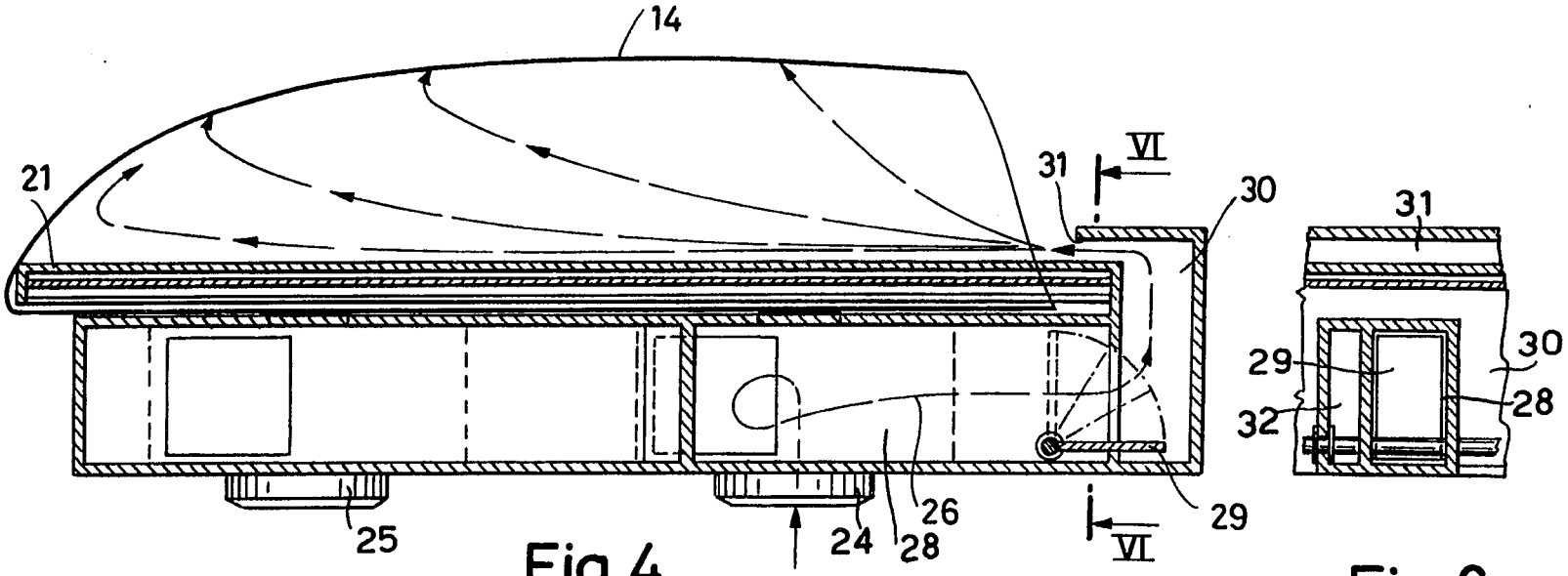
Fig.4
Fig.6
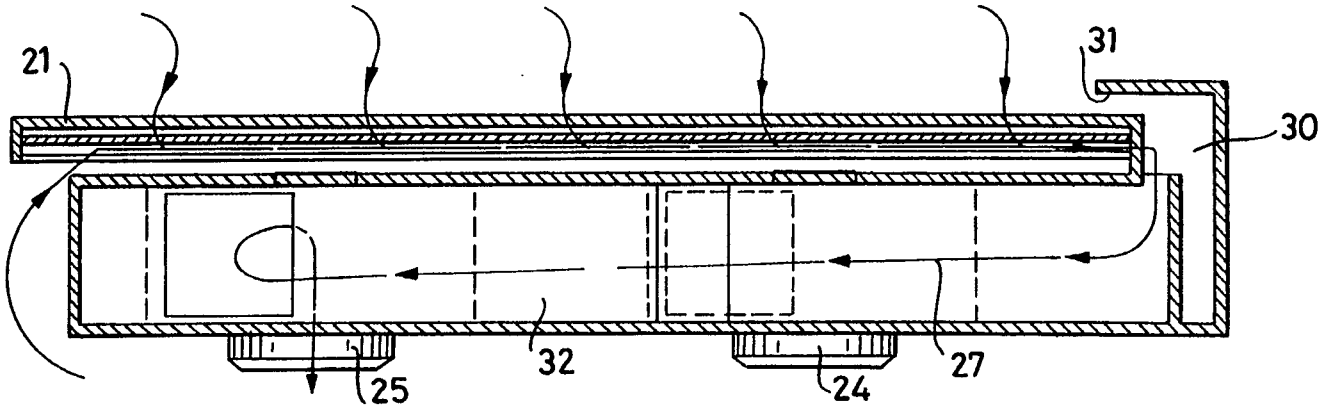
Fig.5

MACHINE FOR PACKAGING WITH SINGLE-FOLDED HEAT-SHRINKABLE FILM, PROVIDED WITH A DEVICE FOR AUTOMATICALLY OPENING THE FILM

BACKGROUND OF THE INVENTION

This invention relates to a machine for packaging with single-folded heat-shrinkable film which is characteristically provided with an air device able to force apart those opposing sides of the film between which the product to be packaged is to be inserted. The expert of the art is familiar with packaging machines which use single-folded heat-shrinkable film, i.e. film folded longitudinally to define two opposing faces which when forced apart define a space into which the product to be packaged is inserted.

The product is fed, inserted between the film faces, to a welding machine which welds the open sides of the film to form a closed envelope. This envelope is then fed into a hot air circulation oven which shrinks the film onto the product, to form the finished package.

A packaging machine of this type is described and illustrated for example in U.S. Pat. No. 4,104,848 granted Aug. 8, 1978, to which reference should be made for further details.

The packaging machine of the cited patent welds and heat-shrinks the film in a single chamber, through which hot air is circulated. The chamber is closed upperly by a preferably transparent movable hood, and the product to be packaged is inserted between the faces of the single-folded film sideways to the hood where a work table is positioned between said film faces.

To place the product to be packaged onto the work table the upper face of the single-folded film has to be raised manually, resulting in a time wastage which can be considerable in that these manual packaging machines are inherently rather slow compared with automatic tunnel machines.

A further drawback of machines of known type is that the film has to be perforated so that the air which was incorporated on inserting the article to be packaged between the two film faces can escape during the heat-shrinkage operation.

Consequently a package is obtained comprising holes which besides detracting from its appearance allow air to enter, this being undesirable particularly in the food field.

SUMMARY OF THE INVENTION

An object of the present-invention is to obviate the aforesaid drawbacks of the known art by providing a machine for packaging with single-folded heat-shrinkable film which comprises a simple and low-cost device able to automatically raise the upper surface of the film so as to create an open space through which the article to be packaged can be rested comfortably on the work table without having to manually handle the film in any way.

A further object of the invention is to provide a machine comprising a device able to eliminate the air present in the film envelope containing the article, so making it unnecessary to perforate the film.

Said objects are attained according to the present invention by a machine for packaging with single-folded heat-shrinkable film, i.e. film folded longitudinally to define two opposing faces between which a work table is interposed, characterised by comprising, for automatically opening the film, a device provided with means for directing between the film faces slightly spaced from the work table a quantity of air able to inflate said film so as to force said faces apart and create a free space into which the article to be packaged can be inserted, said means being substantially coplanar with said work table.

Preferably, said device comprises a blower able to direct a laminar air stream between said film faces by way of a series of ducts.

Preferably, said device also comprises an exhaust fan able to extract the air from said free space when the article to be packaged is fed, wrapped in film, to the packaging machine.

The structural and operational characteristics of the invention and its advantages over the known art will be more apparent from an examination of the following description, given with reference to the accompanying schematic drawings, which show one embodiment of a packaging machine incorporating the principles of the invention. In the drawings:

BRIEF DESCRIPTION OF THE DRAWINGS

FIG. 4 is a section on the line IV—IV of FIG. 8;

FIG. 5 is a section on the line V—V of FIG. 8;

FIG. 6 is a sectional view of a detail taken on the line VI—VI of FIG. 4;

DESCRIPTION OF THE PREFERRED EMBODIMENT

On the drawings, which are provided by way of non-limiting example only, the device of the invention is shown applied to a machine for packaging with heat-shrinkable film, of the type described and illustrated in U.S. Pat. No. 4,104,848, however, the invention can obviously be applied to machines of a different type.

Figure 1:
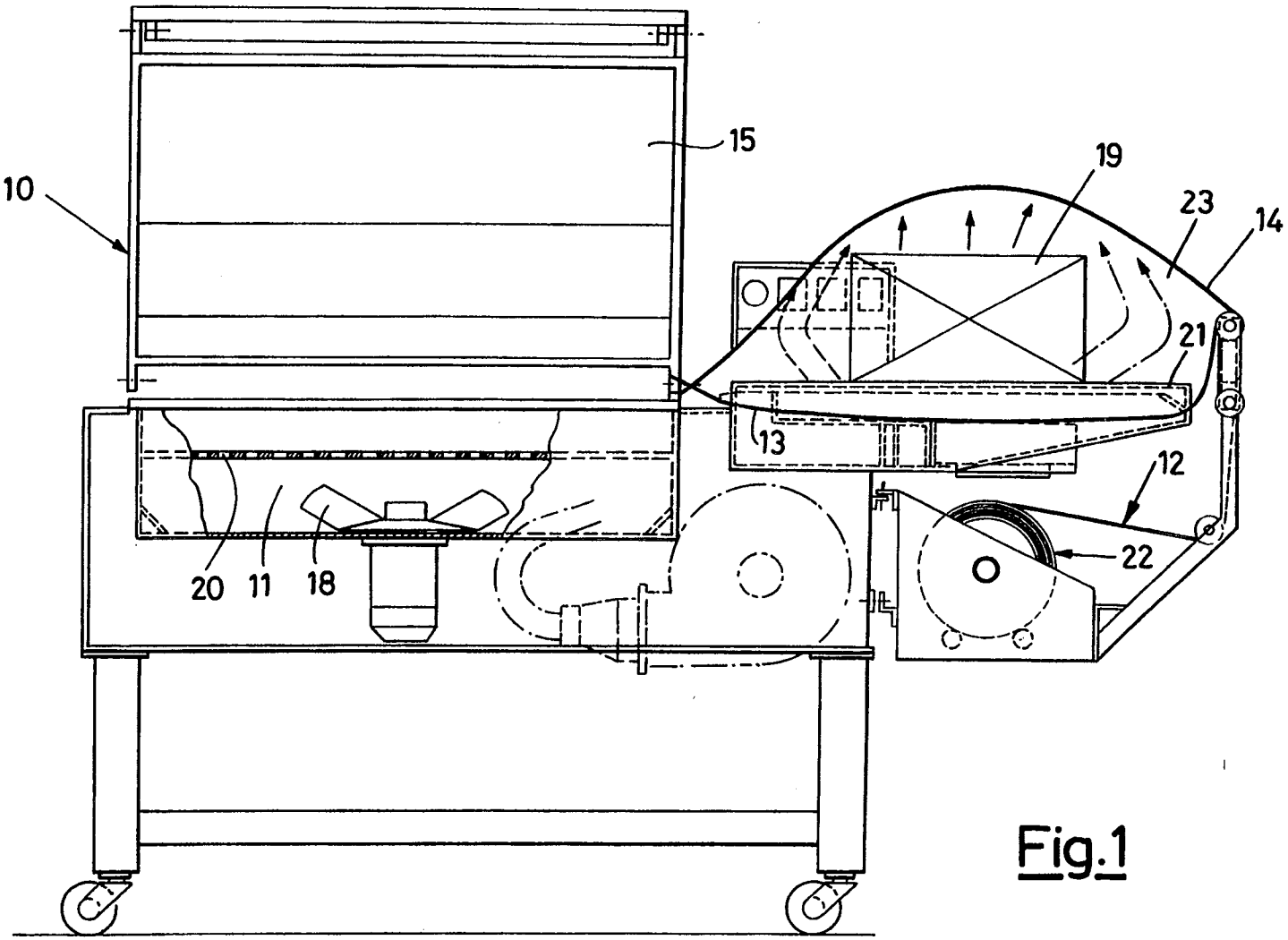
FIG. 1 is a partly cut-away and partly sectional front elevational view showing one embodiment of a packaging machine provided with the device according to the invention.
Figure 2:
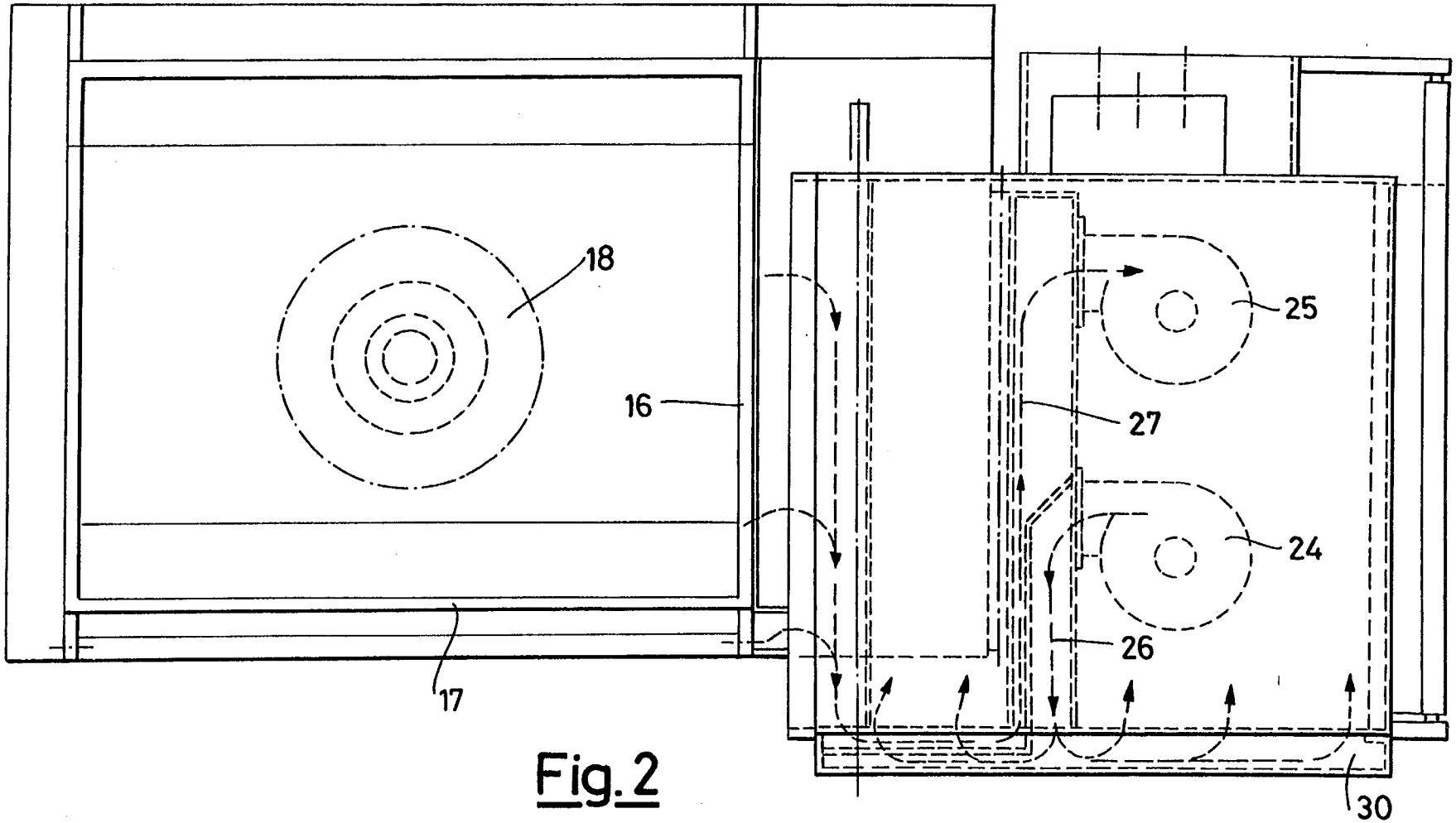
FIG. 2 is a plan view.
Figure 3:
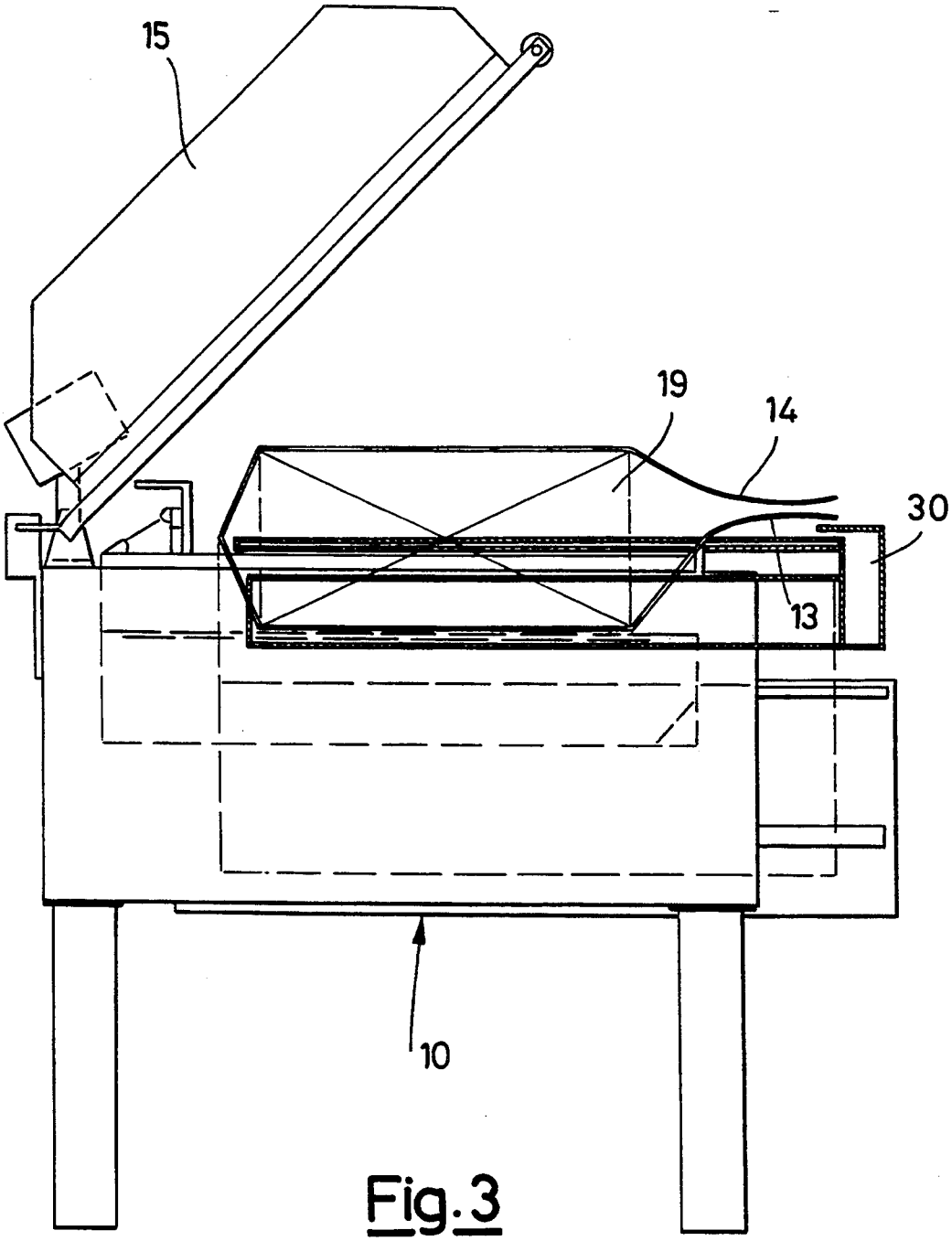
FIG. 3 is a side elevational view.
Figure 7:
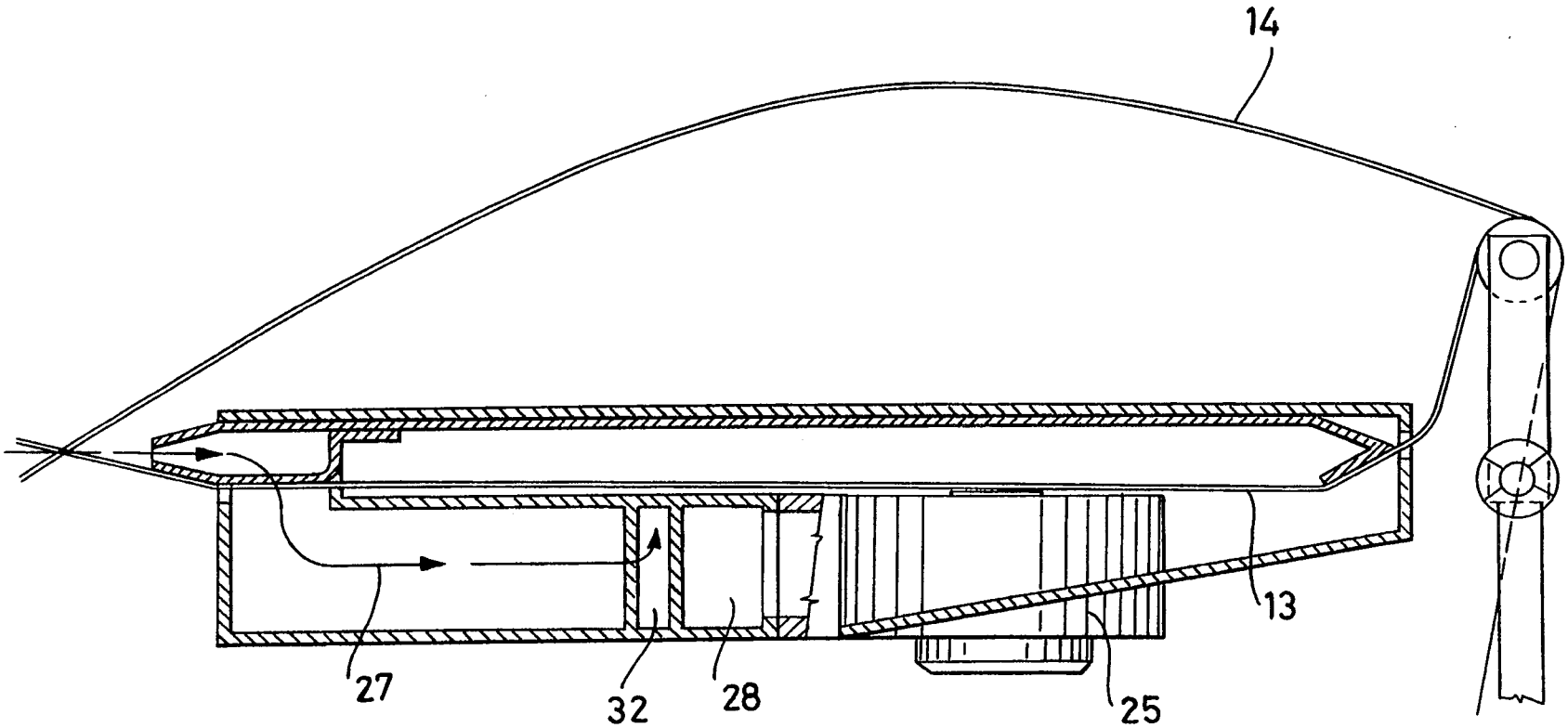
FIG. 7 is a section on the line VII—VII of FIG. 8.
Figure 8:
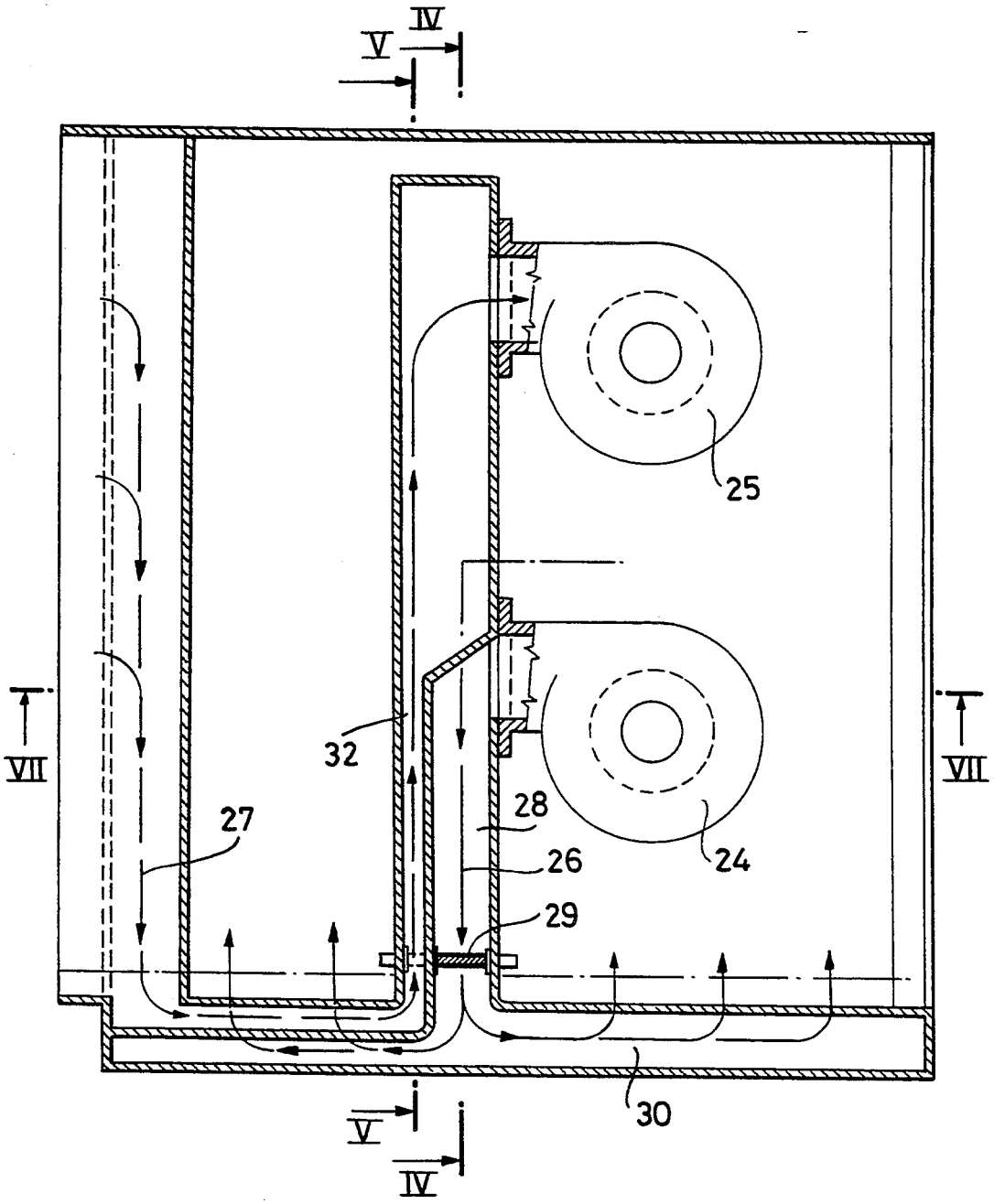
FIG. 8 is a sectional plan view.

With initial reference to FIGS. 1 to 3 of the drawings, the machine of the invention is indicated overall by 10 and comprises a chamber 11 in which a single-folded film 12 comprising a lower face 13 and an upper face 14 is welded and heat-shrunk.

The chamber 11 is closed upperly by a movable hood 15, preferably of transparent material.

Lowering said hood 15 activates welding blades (not shown) positioned on the upper edges 16, 17 of the chamber 11 and one or more blowers 18 which generate air circulation within the chamber 11, the air being heated by electrical resistance elements (not shown). This achieves the welding and heat-shrinkage of the single-folded film 12 wrapping the article 19 to be packaged, which for this purpose is placed on a support grid 20 in the chamber 11.

The machine structure or its method of operation will not be described or illustrated in greater detail herein as these are well known to the expert of the art. Reference can however be made to the aforestated U.S. Pat. No. 4,104,848.

The article 19 to be packaged must be placed by the operator on a work table 21, which is mounted to the side of the chamber 11 and during machine operation is positioned between the lower face 13 and upper face 14 of the single-folded film 12, which is unwound from an underlying reel 22.

In known machines this is done by the operator manually raising the upper face 14 of the film from the work table 21 to define a free space 23 info which the article 19 is inserted.

This operation represents a substantial time wastage considering that manual machines of this type are considered intrinsically rather slow.

According to the invention, the upper face 14 of the film 12 is raised from the work table 21 by blowing between the faces 13 and 14 of the film a quantity of air sufficient to inflate the film in such a manner as to automatically create the free space 23 for receiving the product 19.

In this manner the operator not only does not waste time in manually lifting the upper face 14 of the film, but can handle the article to be packaged with both hands, both for positioning it correctly on the work table 21, and by necessity in the case of articles of a certain weight.

The drawings show by way of non-limiting example a device able to feed air between the faces 13, 14 of the single-folded film, but devices of different structure falling within the principles of the invention could be used for feeding air between the faces 13, 14 of the film in order to withdraw the upper face 14 from the work table 21.

The device shown by way of non-limiting example comprises a blower 24 and an exhaust fan 25, which are positioned below the machine and, via suitable ducts, deliver and withdraw air in the directions of the arrows 26 and 27 respectively, so that the air fed between the faces 13, 14 of the single-folded film to inflate it is then extracted in order not to disturb the subsequent welding and heat-shrinkage.

The ducts and air paths are clearly shown on the drawings. Specifically, FIGS. 2 and 4–8 clearly show that the air fed by the blower 24 through a duct 28 controlled by a damper 29 is fed to a manifold 30 which expels it laminally through a slot 31 to direct it between the work table 21 and the upper face 14 of the single-folded film 12, which is inflated as shown in FIG. 1 to allow easy insertion of the article 19 to be packaged into the space 23 above the work table 21.

The article 19 inserted in this manner between the film faces 13 and 14 is transferred onto the grid 20 in the chamber 11, the air inside the inflated space 23 then being extracted by the exhaust fan 25 via a duct 32 (FIGS. 5, ? and 8). This therefore avoids the need to perforate the film, with all the advantages which this implies.

Although a preferred embodiment of the invention has been specifically illustrated and described herein, it is to be understood that minor variations may be made in the apparatus without departing from the spirit and scope of the invention, as defined the appended claims.

I claim:

1. A machine for packaging articles in a single-folded heat-shrinkable film (12) defined by a fold and two opposing faces (13, 14), means for supporting the film as a roll (22) for rotation about a predetermined axis and effecting film feed in a predetermined direction between an article loading station and a film heat shrinking and sealing station, said article loading station including a work table (21) having opposite spaced edges, means (31) adjacent a first of said work table edges for directing air between free edges of the two opposing film faces (13, 14) disposed adjacent said work table first edge in a direction generally transverse to said predetermined direction and toward a second of said work table edges adjacent which the film fold is adapted to be disposed thereby inflating the film (12) by opening said opposing faces (13, 14) to facilitate the introduction of an article therebetween, first blower means (24) for generating air, first duct means (28, 30) for conducting air from said first blower means (24) to said air directing means (31), said film heat-shrinking and sealing station including means for defining a chamber (11) having a movable hood (15), a support (20) in said chamber means (11) upon which the folded film and an article therein are supported during the heat sealing of the film (12), exhaust means (25) for exhausting air from said chamber means (11) and the interior of the folded film (12) from between the film faces (13, 14) incident to the heat shrinking thereof, means for heat shrinking the folded film (12) into intimate relationship to an article packaged therein, means for heat sealing at least the film face free edges, said heat-shrinking means including second blower means (18) for blowing hot air relative to said support (20) and circulating the hot air in said chamber (11), said first blower means (24) and said exhaust means (25) being disposed generally at said article loading station, second duct means (27, 32) for conducting air from the inflated film (12)to said exhaust means (25), damper means (29) associated with said first duct means (28, 30) for controlling the flow of air therethrough, said first duct means (28, 30) being located beneath said work table (21) and being of a generally transverse configuration defined by a first duct portion (28) disposed generally transverse to a second duct portion (30), said second duct means (27, 32) having first and second duct portions disposed generally adjacent said respective first duct means first (28) and second (30) duct portions, said second duct means (27, 32) having a duct portion (27) disposed generally transverse to said first duct means second duct portion (30), and said damper means (29) being located in said first duct means first duct portion (28).

2. The packaging machine as defined in claim 1 wherein said heat shrinking and sealing station support (20) is perforated to effect circulation of hot air about the exterior of the folded film (12).

3. The packaging machine as defined in claim 1 including means mounting said damper means (29) for pivotal movement.

* * * * *